US005111572A

United States Patent [19]

Haiml et al.

[11] Patent Number: 5,111,572

[45] Date of Patent: May 12, 1992

[54] METHOD OF MECHANICAL SURFACE TREATMENT OF A BLANK METAL SHEET

[75] Inventors: Gottfried Haiml; Johann Langgartner, both of Braunau/Inn, Austria

[73] Assignee: Austria Metall Aktiengesellschaft, Braunau am Inn, Austria

[21] Appl. No.: 660,247

[22] Filed: Feb. 22, 1991

Related U.S. Application Data

[63] Continuation of Ser. No. 487,495, Mar. 1, 1990, abandoned.

[30] Foreign Application Priority Data

Mar. 1, 1989 [AT] Austria ..... A459/89

[51] Int. Cl.[5] ..... B21D 35/00

[52] U.S. Cl. ..... 29/469.5; 29/17.2; 228/235; 228/265

[58] Field of Search ..... 29/17.1, 17.2, 17.3, 29/17.9, 432.1, 432.2, 432, 469.5; 228/235, 265; 156/196, 247

[56] References Cited

U.S. PATENT DOCUMENTS

| | | | |
|---|---|---|---|
| 712,365 | 10/1902 | Dejey | 29/17.9 |
| 2,850,999 | 9/1958 | Kaplan et al. | 29/469.5 |
| 2,879,587 | 3/1959 | Mushovic et al. | 29/17.3 X |
| 2,894,323 | 7/1959 | Sowter et al. | 228/265 X |
| 3,028,667 | 4/1962 | Wintermute et al. | 29/469.5 |
| 3,269,004 | 8/1966 | Smith, Jr. et al. | 228/235 X |
| 3,300,837 | 1/1967 | Fisher et al. | 228/235 X |
| 3,397,438 | 8/1968 | Montoro | 29/17.1 |
| 3,587,266 | 6/1971 | Randich | 29/17.1 X |
| 3,654,016 | 4/1972 | Alexander | 156/247 |
| 3,883,383 | 5/1975 | Leitz, Jr. | 156/247 X |
| 3,886,022 | 5/1975 | Konicek | 156/247 |
| 3,997,099 | 12/1976 | Morisaki | 228/235 X |
| 4,470,011 | 10/1984 | Austin | 228/265 X |

FOREIGN PATENT DOCUMENTS 286913 12/1990 Austria .

*Primary Examiner*—Timothy V. Eley
*Assistant Examiner*—C. Richard Martin
*Attorney, Agent, or Firm*—Herbert Dubno

[57] ABSTRACT

A method of mechanically imparting a surface texture to a bland surface of sheet metal, especially soft aluminum, in which an adherent foil is applied at least to one surface of the sheet metal and is pressed into and against a surface by a roll so that the sheet metal is deformed and the pattern of the deformed foil is pressed into the sheet metal surface.

6 Claims, 1 Drawing Sheet

METHOD OF MECHANICAL SURFACE TREATMENT OF A BLANK METAL SHEET

This is a continuation of co-pending application Ser. No. 487,495, filed on Mar. 1, 1990, abandoned.

FIELD OF THE INVENTION

The present invention relates to a mechanical surface treatment of sheet metal and, more particularly, to a method of mechanically imparting surface texturing to a sheet metal substrate and for protecting the textured surface thereof, e.g. during transport and storage.

BACKGROUND OF THE INVENTION

Usual methods of mechanically treating sheet metal surfaces to impart desired surface properties thereto have hitherto involved grinding, polishing or embossing of the sheet metal surface. In substantially all embossing processes, the negative structure or contour of the desired surface texture of the sheet metal is formed on an embossing body which can be a plate, a roll or a bonding and which is pressed against the sheet metal workpiece.

Since such embossing bodies must be fabricated for each structure to be imparted to the sheet metal, the embossing bodies are rather costly. Furthermore, they tend to wear and must be replaced or resurfaced at comparatively high cost. When large quantities of sheet metal must be processed, the apparatus used is relatively complex since exact positioning of the embossing body is usually required and expensive means must be provided for this purpose.

Furthermore, it must be ensured that no dirt or chips lodge between the embossing body and the sheet metal.

As a consequence, it is necessary at specified intervals to clean the embossing body. In addition, the treated surface of the sheet metal must often be protected from dust and damage by packing the sheet metal or covering the treated surface with a foil which can be stripped off prior to use.

OBJECTS OF THE INVENTION

It is, therefore, the principal object of the present invention to provide an improved method for mechanically texturing a sheet metal surface, i.e. providing the originally flat or blank surface with a predetermined topology or structure, whereby drawbacks of earlier systems are avoided.

Still another object of the invention is to provide an improved method of imparting a structuring to the surface of sheet metal which eliminates the need for an additional step for protecting the textured surface.

SUMMARY OF THE INVENTION

These objects and others which will become apparent hereinafter are attained, in accordance with the invention in that an adherent foil is applied to a surface of a sheet metal workpiece or substrate to which a surface structure or texture is to be imparted and the adherent foil is then pressed against this surface of the sheet metal to deform the sheet metal and press a pattern of the deformed foil into the sheet metal surface. The foil which is used can o also be completely smooth originally and can simply transmit surface structure to the metal workpiece. The profiling or texture can, in that case, be effected only by deformation of the foil during the rolling and pressing of the deformed foil into the metal.

As will be apparent from the discussion below, the pressing roll can be formed with a structured surface which is transmitted through the foil to the sheet metal. Alternatively, the surface of the foil facing the sheet metal can be previously provided with a surface structuring which is pressed into the sheet metal. In still another alternative, because of the manner in which the foil is fed onto the surface of the sheet metal, the texture of the foil can result from a wrinkling or the like which is pressed into the sheet metal.

The foil is used only once and remains adherent to the sheet metal following the embossing of the latter. As a consequence, wear of the foil is immaterial. The foil itself is of low cost and the apparatus with which it is used also is of comparatively low cost.

According to a feature of the invention, the foil can initially be placed on the sheet metal and then can be rolled thereagainst. Alternatively, the foil can be fed between the sheet metal and the roll and applied by the roll to the sheet metal simultaneously with the rolling. If the foil is to remain as a protective layer for transporting and intense handling of the embossing sheet metal, it is advantageous to bond the foil to the sheet metal with an adhesive which can be applied to the foil surface facing the sheet metal.

If the foil is to serve only as a protective covering during storage and as a protection against soiling of the surface, it is not necessary to use a foil with an adhesive layer since, during the rolling process the structured surfaces of the sheet metal and foil are so pressed against one another that they interfit and thus are held snugly together. In both cases, effective protection of the metal surface can be obtained. Naturally the foil can be stripped from the metal surface for use.

According to another feature of the invention the foil which is employed has at its side facing the sheet metal a surface which can be additionally imparted to the sheet metal together with any structure resulting from wrinkling of the foil or the like or impression of the foil by the roll.

It has been found to be advantageous to control the texturing of the foil by varying the ratio of the peripheral speed of the pressing roll and the speed of advance of the sheet metal and the roll pressure, thereby controlling the deformation of the foil and the sheet metal. In this manner the deformation of the foil and of the underlying sheet metal surface can be additionally altered during the rolling and the characteristics of the textured surface controlled.

It is a special advantage of the invention that no specially polished structured roll need be used and that one can use a roll with a normal bright finish. With the method of the invention, moreover, it is possible to effect a thickness reduction in the sheet metal so that special rolling steps for thickness reduction by a rolling mill stand can be eliminated.

The foil can be any foil capable of imparting structure or texture to the sheet metal surface and may be a metal foil such as an aluminum foil or a synthetic resin foil. What is especially advantageous is that the sheet metal which is used be soft high purity aluminum or a soft aluminum alloy since, with such sheet metal, the sheet metal surface is easily deformable and relatively small forces suffice for the surface structuring.

The method of the invention can be used to produce sheet metal having highly diffuse light scattering and thus be especially suitable for use as an optical reflector. The sheet metal can also be used effectively for deep drawing or other stamping or pressing workpieces since the surface texture affords excellent lubricant entrainment and, because of the lubricant pockets formed by the textured surface, greatly facilitates deep drawing and the like.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
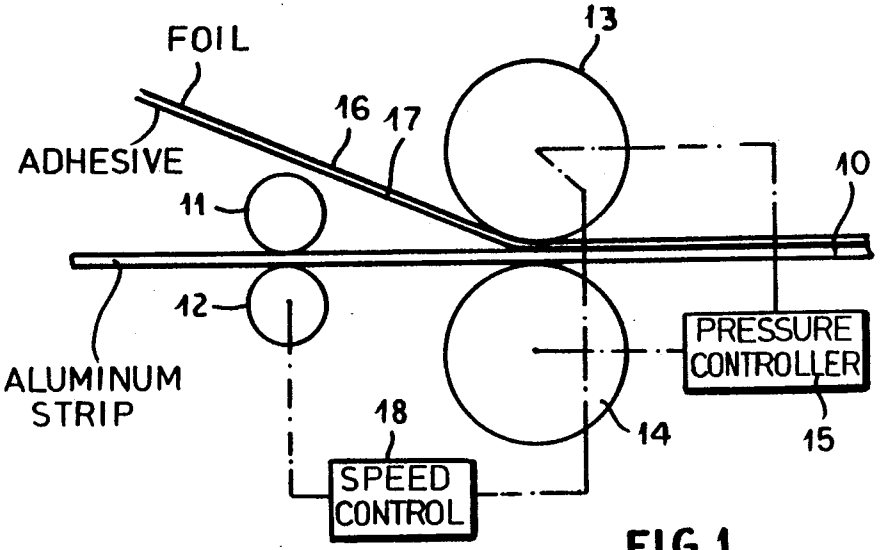
FIG. 1 is a diagrammatic elevational view illustrating an apparatus for carrying out the method of the invention.

As can be seen from FIG. 1, a soft sheet metal aluminum strip 10 can be fed by feed rollers 11 and 12 between a pair of pressing rolls 13 and 14. A roll pressure controller 15 can be provided to vary the roll pressure and thereby contribute to the texturing in the manner described.

A foil 16 of the type described previously, having its surface turned toward the sheet metal coated with a pressure sensitive adhesive 17 is fed between the pressing roll 13 and the sheet metal. According to the invention, the sheet metal and foil are so fed that the roll 13 causes a wrinkling or texturing of the foil against the surface of the sheet metal as the foil is pressed thereagainst to impart that texture to the surface of the metal substrate. For this purpose, a speed control 18 is provided to vary the speed at which the strip 10 is fed between the rolls 13 and 14 relative to the speed of the roll 13. The adhesive 17 ensures that the foil will remain in place for transport and storage of the sheet metal. The surface of the roll 13 may be textured and the side of the foil turned toward the sheet metal may likewise be structured as described below.

Figure 2:
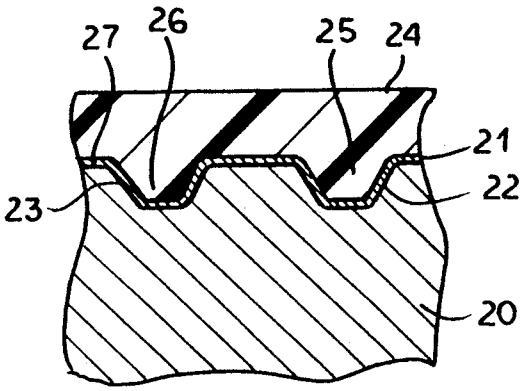
FIG. 2 is a cross sectional view greatly enlarged in scale by comparison with FIG. 1 and reality, illustrating features of the invention.

In FIG. 2 there is shown the product which results from a surface texturing process of the invention. In this case, the effect of wrinkling on the texturing system has not been illustrated and the thickness of the various elements have been greatly exaggerated. In FIG. 2 the sheet metal substrate is represented at 20 and has a surface 21 which has been embossed with grooves 22 and 23 which define the surface structuring. As is also apparent from this figure, the foil 24 has foil portions 25 and 26 which penetrate into the grooves 22 and 23. An adhesive layer 27 is likewise shown to be present although, as noted, this adhesive layer can be omitted.

Figure 3:
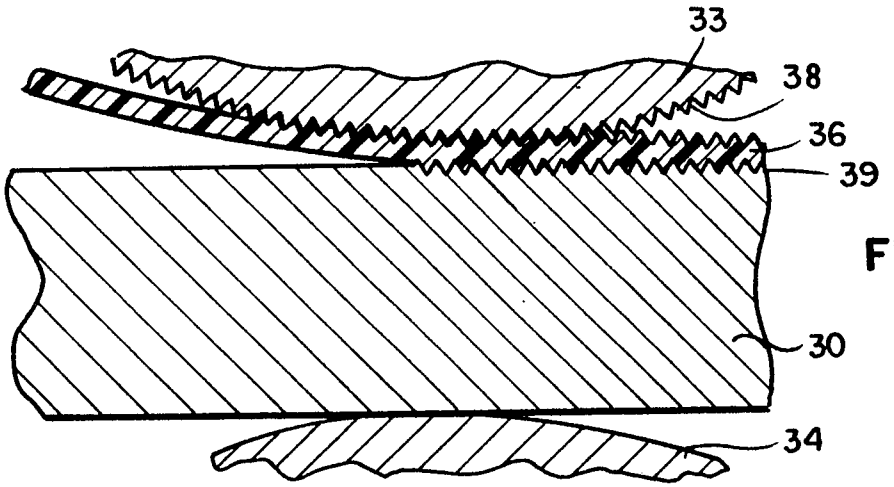
FIG. 3 is a fragmentary section illustrating another aspect of the invention.

From FIG. 3 it will be apparent that the roll 33 which presses the foil 36 against the sheet metal workpiece 30 can be provided with surface texture 38 which is imposed upon the wrinkling of the foil caused by the greater peripheral speed of the roll 33 in the speed of advance of the sheet metal 30 between the rolls 33 and 34. While no adhesive is used in this system, the interfitting surface texturing at the interface 39 between the foil and the sheet metal ensures effective retention of the foil on the sheet metal until it is stripped away.

We claim:

1. A method of mechanically structuring a blank surface of a sheet metal workpiece, comprising the steps of:

(a) applying to said blank surface of said sheet metal workpiece an adherent but non-adhesively bonded foil;

(b) pressing said foil against said surface with a roll, thereby deforming said surface and impressing a texture of said foil in a deformed state into said surface;

(c) during said pressing of said foil against said surface in step (b) varying a ratio of peripheral speed of said roll to speed of advance of said workpiece and varying a pressure of said roll against said workpiece to control said deformation of said foil and said sheet metal, said varying of ratio and pressure being performed during said pressing step; and (d) recovering the sheet metal with a deformed and textured surface.

2. The method defined in claim 1 wherein said foil is formed with a side thereof confronting said surface with a surface texture which is at least partially imparted to said sheet metal surface.

3. The method defined in claim 2 wherein said at least partially imparted surface texture arises from wrinkling of said foil.

4. The method defined in claim 1 wherein said sheet metal is composed of soft pure aluminum or a soft aluminum alloy.

5. The method defined in claim 1, further comprising the step of removing said foil from said sheet metal.

6. A method of mechanically structuring a blank surface of a sheet metal workpiece, comprising steps of:

(a) applying to said blank surface of said sheet metal workpiece an adherent but non-adhesively bonded foil;

(b) pressing said foil against said surface with a roll, thereby deforming said surface and impressing a texture of said foil in a deformed state into said surface;

(c) varying a ratio of peripheral speed of said roll of speed of advance of said workpiece and varying a pressure of said roll against said workpiece to cause wrinkling of said foil and thereby control of the deformation of said foil and said sheet metal, said varying of ratio and pressure being performed during said pressing step; and (d) recovering the sheet metal with a deformed and textured surface covered by said foil as a protective layer.

* * * * *